US006593692B2

(12) United States Patent
Kitahara et al.

(10) Patent No.: US 6,593,692 B2
(45) Date of Patent: Jul. 15, 2003

(54) HIGH PRESSURE DISCHARGE LAMP WITH LONG LIFE

(75) Inventors: Yoshiki Kitahara, Takatsuki (JP); Takashi Tsutatani, Takatsuki (JP); Toshiyuki Shimizu, Takatsuki (JP)

(73) Assignee: Matsushita Electric Industrial Co., Ltd., Osaka-fu (JP)

( * ) Notice: Subject to any disclaimer, the term of this patent is extended or adjusted under 35 U.S.C. 154(b) by 131 days.

(21) Appl. No.: 09/853,455

(22) Filed: May 10, 2001

(65) Prior Publication Data

US 2003/0020394 A1 Jan. 30, 2003

(30) Foreign Application Priority Data

May 12, 2000 (JP) ..... 2000-140903

(51) Int. Cl.[7] ..... H01J 61/12; H01J 1/62

(52) U.S. Cl. ..... 313/571; 313/491; 313/570; 313/568; 313/639; 313/631

(58) Field of Search ..... 313/491, 565, 313/566, 490, 568, 571, 572, 574, 631, 639

(56) References Cited

U.S. PATENT DOCUMENTS 3,067,357 A 12/1962 Fridrich 6,271,628 B1 8/2001 Sugitani et al.

FOREIGN PATENT DOCUMENTS

| | | |
|---|---|---|
| DE | 3305468 | 8/1984 |
| EP | 901151 | 3/1999 |
| GB | 2043331 | 10/1980 |
| JP | 4280057 | 10/1992 |

OTHER PUBLICATIONS

U.S. patent application 2001/0038267 A1 Ono et al. Nov. 8, 2001.*

* cited by examiner

*Primary Examiner*—Nimeshkumar D. Patel
*Assistant Examiner*—Sharlene Leurig

(57) ABSTRACT

A short-arc high pressure discharge lamp with a shorter distance between electrodes than a conventional lamp that realizes a long life of at least 3000 hours and suppresses the arc jump phenomenon is disclosed. In the high pressure discharge lamp, an electrode tip 124 is transformed into a semi-sphere by fusing and processing an electrode rod 122 and a coil 123 wound around an end of the electrode rod 122. A thickness "de" and a diameter "φe" of the semi-sphere are each set in a range predetermined in correspondence with a power input (W) of the short-arc high pressure discharge lamp.

9 Claims, 8 Drawing Sheets

HIGH PRESSURE DISCHARGE LAMP WITH LONG LIFE

This application is based on an application No.2000-140903 filed in Japan, the content of which is hereby incorporated by reference.

BACKGROUND OF THE INVENTION (1) Field of the Invention

The present invention relates to a high pressure discharge lamp, and particularity to improvements in an electrode for use in a high pressure discharge lamp of a short-arc type in which the distance between electrodes is made shorter than a conventional lamp.

(2) Related Art

In recent years, there has been active development for projection type image display apparatuses such as liquid crystal projectors. Such projection type image display apparatuses require high intensity light sources close to a point light source. As this kind of light source, short-arc high pressure discharge lamps, such as short-arc super-high pressure mercury lamps or short-arc metal-halide lamps are typically used.

These short-arc super-high pressure mercury lamps and short-arc metal-halide lamps conventionally used in the projection type image display apparatuses have employed tungsten electrodes with the same construction as those used in long-arc high pressure discharge lamps for general lighting. FIG. 1 shows an example of such a conventional electrode. As shown in the figure, an electrode 901 is usually composed of an electrode rod 902 made of tungsten and a coil 903 made of a tungsten wire having a narrow wire diameter.

However, such a short-arc high pressure discharge lamp that employs the electrode 901 has the following disadvantage. When the high pressure discharge lamp is lit, a tip of the electrode 901 is excessively heated, so that tungsten that forms the electrode 901 melts and evaporates. This blackens an inner surface of an arc tube, and also, deforms and wears the tip of the electrode 901. Accordingly, the high pressure discharge lamp cannot have a longer life. To overcome this disadvantage, various techniques have been devised aiming at improving electrodes.

As one technique for lengthening a life of a high pressure discharge lamp, an electrode that has been subjected to a fusing process so that the tip of the electrode is substantially shaped into a semi-sphere (such an electrode whose tip forms a semi-sphere is hereafter referred to as an "improved electrode") has been proposed. Japanese Patent No. 2820864 and Japanese Laid-Open Patent Application No. H10-92377 disclose techniques relating to such an improved electrode. FIGS. 2A and 2B are drawings for explaining a conventional improved electrode. An electrode 911 shown in the figures is produced in the following way. A coil 913 made of a tungsten wire is fixed around an electrode rod 912 made of tungsten as shown in FIG. 2A. The tip of the electrode rod 912 and a portion of the coil 913 are subjected to a fusing process with an electric discharge method to form an electrode tip 914 which is substantially a semi-sphere as shown in FIG. 2B.

The electrode tip 914 features the electrode 911. Since the electrode tip 914 has been made by fusing the portion of the coil 913, the heat generated in the electrode tip 914 at lighting is transferred rapidly to the coil 913, lowering the temperature of the electrode tip 914. This prevents tungsten from melting and evaporating, and further prevents the inner surface of the arc tube from being blackened and the end of the electrode 911 from being deformed and worn out. Accordingly, a life of a lamp employing the electrode 911 can be lengthened.

In recent development of short-arc high pressure discharge lamps for use in projection type image display apparatuses, two goals have been set. The two goals are (1) to improve luminance on a screen and (2) to provide varieties of lamps having the lamp power input approximately in the range of 50 to 400W, in view of keeping up with the recent trend towards diverse projection type image display apparatuses varying in area of a screen to be normally employed. As one approach to achieve goal (1), particularity to improve efficiency for light utilization when a reflective mirror is used in combination, the distance between electrodes "De" is shortened from the conventional distance of above 1.5 mm but not more than 2.5 mm, to the distance of 1.5 mm or shorter. Although active development has been made to provide short-arc high pressure discharge lamps in which the distance between electrodes is shorter than conventional lamps, mainly two problems lie ahead. One is that the shorter distance between electrodes leads to more serious deformation and wear of the electrode tip, accelerating the blackening of the inner surface of the arc tube. Due to this, the lamp life is shortened. The other unique problem that has become distinct is that an arc jump phenomenon occurs more frequently.

The following explains the arc jump phenomenon, with reference to FIG. 3. As shown in the figure, the arc jump phenomenon is a phenomenon where a luminescent spot of an electrode (a spot where an electronic current is discharged when the cathode is impressed) that is initially formed around the center of the electrode tip in a steady lighting state, changes its position in disorder with aging of the lamp. When the arc jump phenomenon occurs, a discharge arc deviates from the optical axis of a lamp unit in which a reflective mirror is incorporated. This causes significant fluctuation of luminance on a screen illuminated with the lamp unit.

As described above, for developing short-arc high pressure discharge lamps in which the distance between electrodes is made shorter than conventional lamps, two particular technical subjects are to be addressed. The two subjects are (1) to accomplish a lamp life of at least 3000 hours and (2) to provide high quality lamp characteristics for suppressing luminance fluctuation on the screen caused by an occurrence of the arc jump phenomenon.

SUMMARY OF THE INVENTION

In view of the above subjects, the object of the present invention is to provide effective techniques for realizing a long life of at least 3000 hours of a high quality high pressure discharge lamp of the short-arc type in which the distance between electrodes is shorter than a conventional lamp, and for suppressing luminance fluctuation on a screen illuminated using the high pressure discharge lamp.

The above object can be achieved by a high pressure discharge lamp, including: an arc tube having sealing parts at both ends thereof and a discharge space formed in the arc tube; two electrodes extending respectively from the sealing parts into the discharge space, so as to face each other with a predetermined distance "De" therebetween, each electrode being composed of an electrode rod and a coil wound around an end of the electrode rod; and mercury being filled in the discharge space in such a manner that a mercury vapor pressure therein in a steady lighting state is in the range of 15 MPa to 35 MPa inclusive; wherein the distance "De" is in the range of 0.5 mm to 1.5 mm inclusive, a tip of each electrode has been formed into a semi-sphere by fusing the electrode rod and the coil, and a thickness "de" and a diameter "φe" of the semi-sphere are each in a range predetermined in correspondence with a power input of the high pressure discharge lamp.

The above arrangements have taught that a short-arc high pressure discharge lamp having various lamp power input (W) in which the distance between electrodes is shorter than a conventional lamp can realize a long life and can effectively suppress the arc jump phenomenon.

BRIEF DESCRIPTION OF THE DRAWINGS

These and other objects, advantages and features of the invention will become apparent from the following description thereof taken in conjunction with the accompanying drawings that illustrate a specific embodiment of the invention.

In the drawings.

DESCRIPTION OF THE PREFERRED EMBODIMENT

Figure 1:
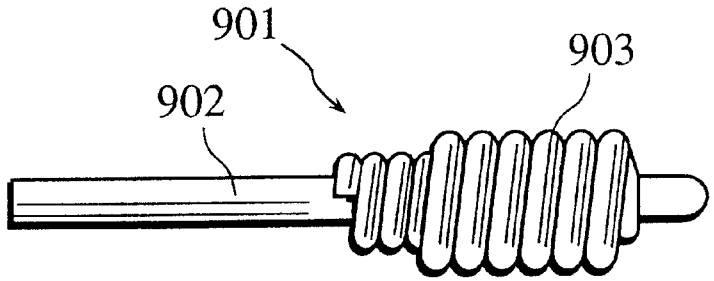
FIG. 1 shows an example of a tungsten electrode having the same construction as that conventionally used in a long-arc high pressure discharge lamp for general lighting.

The following explains how the inventors managed to come up with the present invention. The inventors of the present invention have made thorough examinations of various techniques to find a solution to the above described two technical subjects, in view of providing varieties of short-arc high pressure discharge lamps with the distance between electrodes "De" of 1.5 mm or less, which is shorter than conventional lamps, and with the lamp power input ranging from 50 to 400W. The inventors first examined variations in designs of such conventional electrodes as shown in FIG. 1, or variations in compositions of charged materials, using the conventional electrodes. However, the inventors only found out that an electrode tip is deformed and worn out more seriously as the aging time of a lamp is longer, and could not discover an effective technique for solving the two technical subjects, namely, lengthening a lamp life and suppressing the arc jump phenomenon.

Figure 2A:
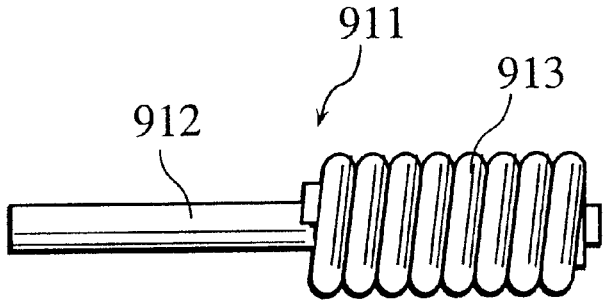
FIGS. 2A and 2 Bare drawings for explaining a conventional improved electrode.
Figure 2B:
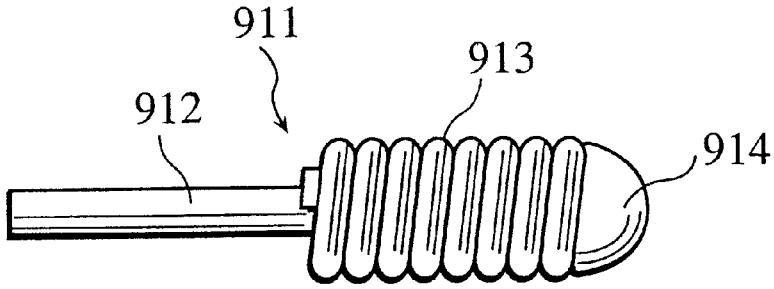
Figure 3:
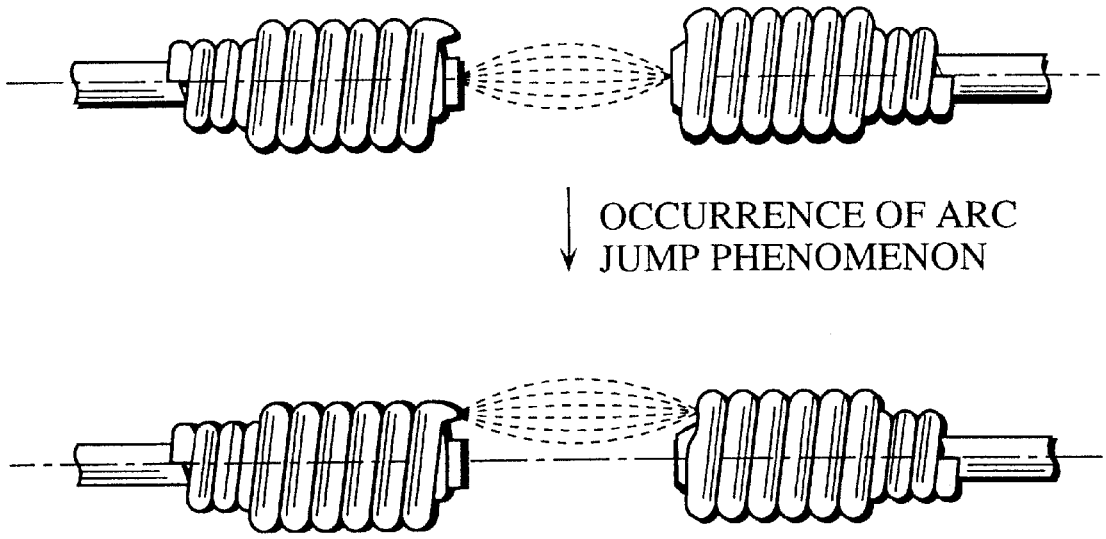
FIG. 3 is a drawing for explaining an arc jump phenomenon.

Secondly, the inventors sought for an effective technique for improving the lamp life and suppressing the arc jump phenomenon as much as possible, by employing a conventional improved electrode shown in FIG. 2B. However, the inventors found out that it was extremely difficult to set such an optimum construction of the improved electrode as to solve the two technical subjects for each kind of lamp. Known from their examinations is that an electrode construction aiming to solve one of the two technical subjects does not necessarily address the other subject.

However, the inventors continued their efforts to find a solution to the two technical subjects with the improved electrode. As a result, the inventors have come up with the present invention that specifies an optimum construction of an electrode that can improve a lamp life and at the same time suppress the arc jump phenomenon.

In detail, a high pressure discharge lamp of the present invention is constructed as follows. The high pressure discharge lamp includes an arc tube having sealing parts at both ends thereof and a discharge space formed therein. Inside the discharge space are two electrodes respectively extending from the sealing parts so as to face each other with a predetermined distance "De" therebetween. Here, the distance "De" is set in the range of 0.5 to 1.5 mm inclusive, and the amount of mercury to be charged is set so that the mercury vapor pressure in the discharge space in the steady lighting state is in the range of 15 to 35 MPa inclusive. A tip of each electrode rod and a portion of a coil wound around an end of the electrode rod are fused to form an electrode tip that is a semi-sphere. Also, a thickness "de" and a diameter "φe" of the semi-sphere are set in ranges predetermined for each lamp power input (W).

The predetermined ranges vary depending on the lamp power input (W). By setting the thickness "De" and the diameter "φe" of the semi-sphere at the electrode tip in ranges that the inventors of the present invention have specified, a life of a lamp with each lamp power input can be lengthened, and at the same time the arc jump phenomenon can be suppressed, thereby preventing luminance fluctuation on a screen.

Preferred Embodiment

The following explains a preferred embodiment of the high pressure discharge lamp relating to the present invention, with reference to the drawings.

Figure 4:
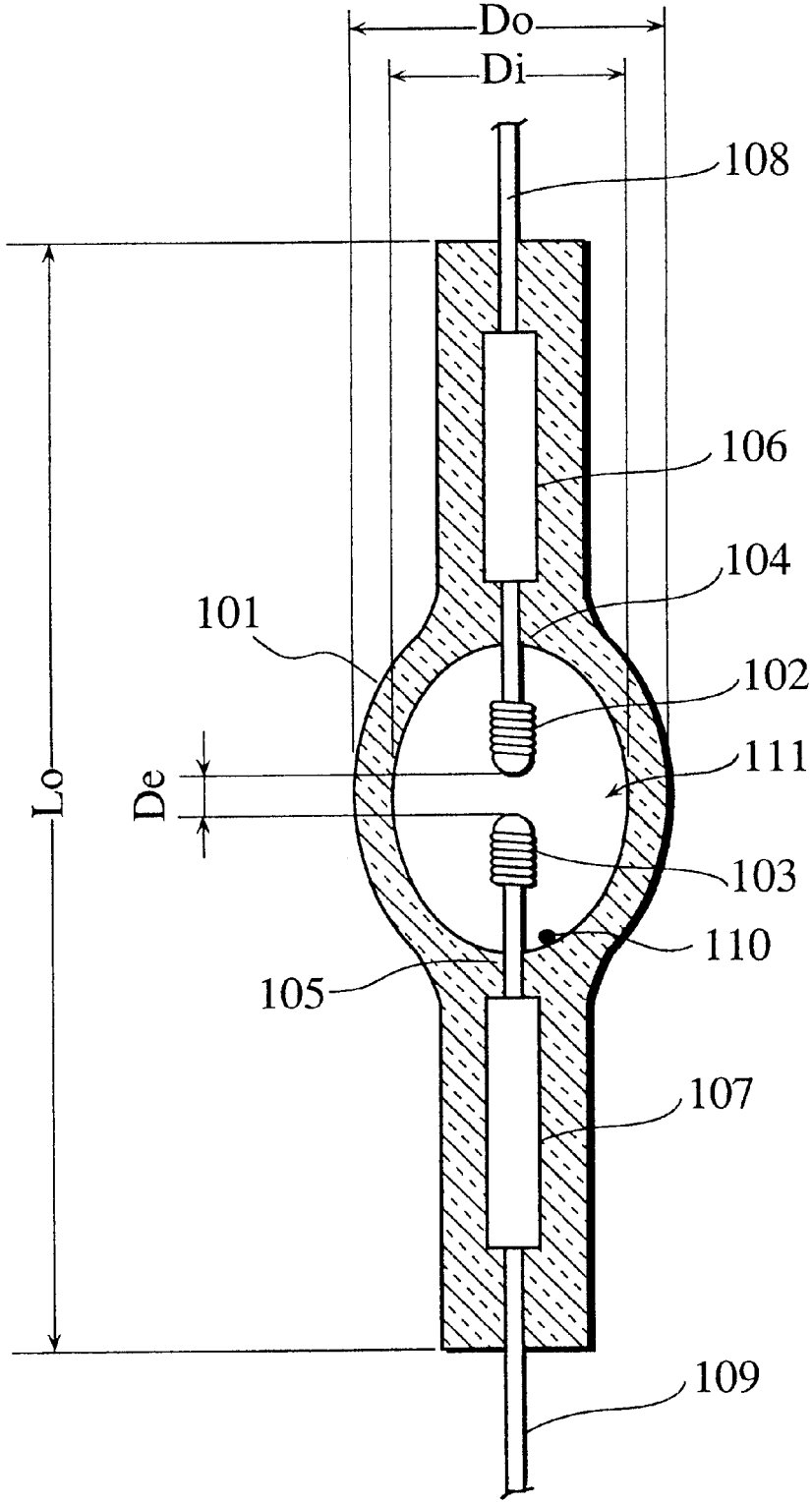
FIG. 4 shows a construction of a super-high pressure mercury lamp relating to a preferred embodiment of the present invention.

FIG. 4 shows the construction of the super-high pressure mercury lamp relating to the embodiment of the present invention. As shown in the figure, the super-high pressure mercury lamp is roughly constructed of an arc tube 101 with a discharge space 111 therein, having sealing parts 104 and 105 at the ends of the discharge space 111. Inside the discharge space 111 are two electrodes 102 and 103 extending respectively from the sealing parts 104 and 105 so as to face each other with a predetermined distance "De" therebetween. The electrodes 102 and 103 each have the basic construction identical to that of the improved electrode described earlier, which has an optimum construction set for each lamp power input (W) in view of improving the lamp life and suppressing the arc jump phenomenon. The optimum construction will be explained in detail later in this specification.

An enveloping vessel of the arc tube 101 is made of quartz and has a substantially spheroid shape. A pair of the electrodes 102 and 103 made of tungsten are respectively hermetically sealed in the sealing parts 104 and 105 via molybdenum foil 106 and molybdenum foil 107 respectively. The molybdenum foil 106 and the molybdenum foil 107 are further connected respectively to external molybdenum lead wires 108 and 109. In the present embodiment, the arc tube 101 has the length "$L_0$" in the range of 30 to 100 mm, the maximum outer diameter "$D_0$" in the range of 5 to 20 mm, and the maximum inner diameter "Di" of the discharge space 111 in the range of 2 to 14 mm.

The distance between the electrodes 102 and 103 "De" is conventionally set in the range of above 1.5 but not more than 2.5 mm. In the high pressure discharge lamp of the present invention, however, to further improve luminance on a screen by enhancing the efficiency for light utilization of the lamp, the distance "De" is set at 1.5 mm or shorter, more preferably set in the range of 0.5 to 1.5 mm.

The discharge space 111 is charged with mercury 110 that is a light emitting material, and rare gases such as argon, krypton, and xenon as starting aids, together with halogen such as iodine or bromine. In the present embodiment, the charged amount of the mercury 110 is preferably set in the range of 150 to 350 mg/cm$^3$ of the volume of the discharge space 111 (equivalent to approximately 15 to 35 MPa of the mercury vapor pressure in the steady lighting state of a lamp). It is desirable to set the charged pressure of the rare gases in the range of 10 to 1000 Kpa at cooling of the lamp.

Usually, bromine in the range of $10^{-9}$ to $10^{-5}$ mol/cm$^3$ is used as halogen. The purpose of charging the bromine into the discharge space 111 is to utilize a so-called halogen cycle effect. Due to the halogen cycle effect, tungsten that has vaporized and dispersed from the electrodes to the vicinity of the inner surface of the arc tube returns to the electrodes. This is effective in suppressing the blackening of the arc tube. The tube wall loading "We" of the arc tube 101 (a value obtained by diving the lamp power input by a total area of the inner surface of the enveloping vessel of the arc tube 101) is set relatively high, specifically at 0.8W/mm$^2$ or higher, to realize luminous efficiency close to the maximum luminous efficiency possible with a quartz arc tube. The luminous efficiency of a high pressure discharge lamp basically increases in a direct relation to the tube wall loading "We". Therefore, to increase the luminous efficiency, a value "We" is set as high as possible to such an extent that is equivalent to the critical temperature (around 1350K) at which the quartz arc tube is bearable in the steady lighting state.

Figure 5:
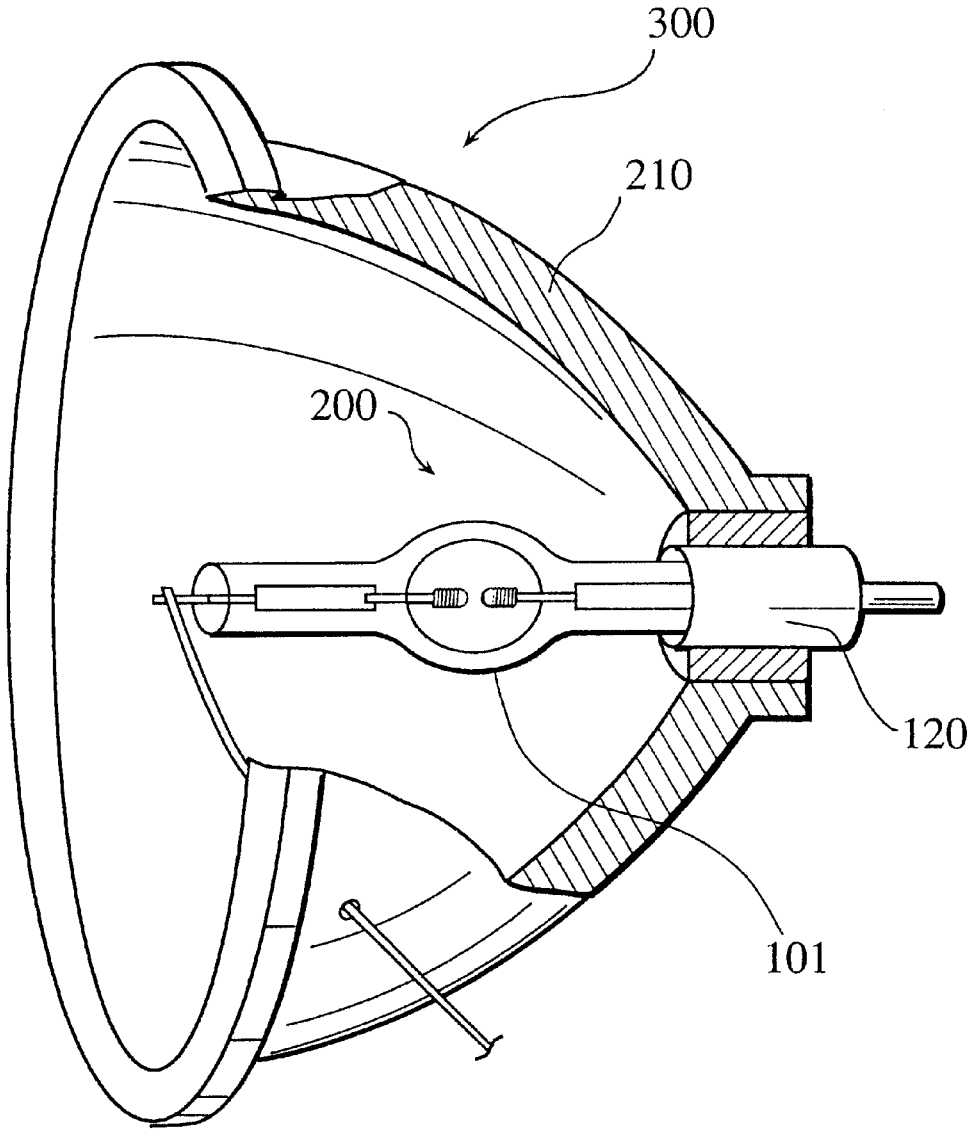
FIG. 5 shows a construction of a lamp unit 300.

As shown in FIG. 5, a completed lamp 200 is constructed of the arc tube 101 whose one end is attached to a base 120. Also, a reflective mirror 210 is attached to the completed lamp 200 to form a lamp unit 300.

As described earlier, the inventors of the present invention made thorough examinations aiming at developing varieties of high pressure discharge lamps each having a shorter distance "De" between electrodes than conventional lamps and the lamp power input in the range of 50 to 400W, using the arc tube 101 basically constructed as shown in FIG. 4. In this process, to find a solution to the two technical subjects, namely, achieving a long lamp life and suppressing the arc jump phenomenon, the inventors examined the relationship between (a) the conditions relating to the above two subjects and (b) the construction of the electrodes 102 and 103.

Figure 6A:
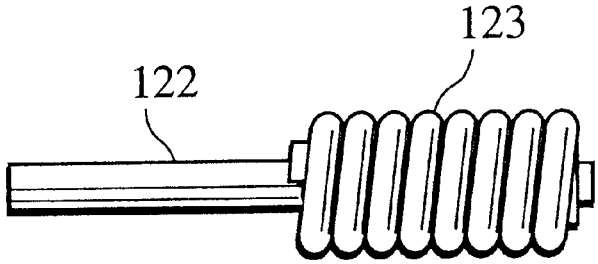
FIGS. 6A and 6B are drawings for explaining a basic construction of electrodes 102 and 103 employed in the embodiment of the present invention.
Figure 6B:
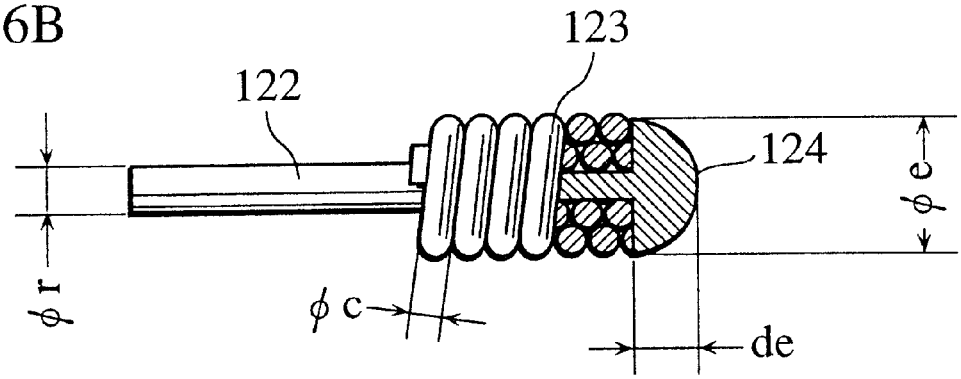

An explanation is first given on the basic construction and the manufacturing process of the electrodes 102 and 103 employed in the examinations. The electrodes 102 and 103 are basically constructed in the same way as the improved electrode depicted in FIG. 2B, and manufactured in the following way. As shown in FIG. 6A, (1) a double-layer winding coil 123 made of a tungsten wire is fixed around an electrode rod 122 made of tungsten. As shown in FIG. 6B, (2) the tip of the electrode rod 122 and the double-layer winding coil 123 is fused and processed by the argon plasma welding apparatus with the electric discharge method, to transform the electrode tip 124 into a semi-sphere.

Figure 7:
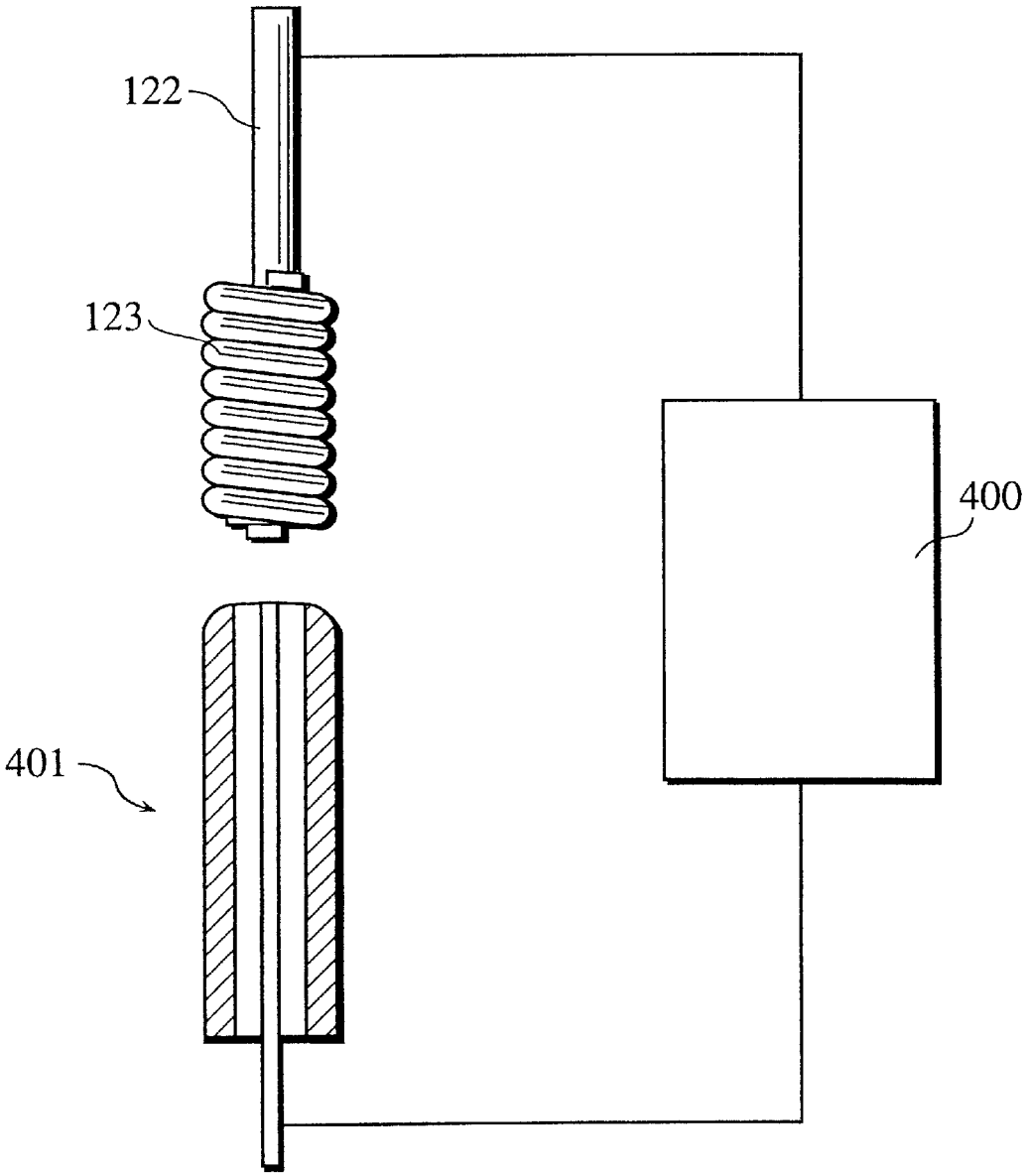
FIG. 7 schematically shows a basic construction of an argon plasma welding apparatus used for an electric discharge method for an electrode tip in the embodiment of the present invention.

FIG. 7 schematically shows the basic construction of an argon plasma welding apparatus 400 used for the electric discharge method. As shown in the figure, the argon plasma welding apparatus 400 is provided with a cathode 401. To subject the electrodes 102 and 103 to a fusing process, the electrode rod 122 made of tungsten with the shaft diameter of 0.4 mm, around which the double-layer winding coil 123 (having eight turns) made of a tungsten wire with the wire diameter of 0.2 mm is fixed, is disposed so as to face the cathode 401 with a predetermined spacing therebetween. The following explains the electrode manufacturing process in more detail.

In the electrode manufacturing process employed in the present embodiment, the distance between a tip of the electrode 122 with the coil 123 and the cathode 401 of the argon plasma welding apparatus 400 is set at 1.0 mm, and the tip of the electrode rod 122 with the coil 123 is fused and processed by arc discharge. This fusing process involves intermittent arc discharge of a plurality of times with at least one cooling period therebetween. As one example, a fusing process performed by arc discharge of a plurality of times is repeated intermittently with a cooling period after each fusing process.

The following explains an example of the intermittent fusing process employed in the present embodiment in detail. The first fusing process is performed by arc discharge of a predetermined arc current (26A as one example) for a predetermined duration (50 millisecond as one example) a predetermined number of times (three times as one example) with a predetermined time interval (0.4 seconds as one example) The arc discharge of three times transforms the tip of the electrode rod 122 and the coil 123 substantially into a semi-sphere, but not yet into a perfect semi-sphere.

Following this, a cooling period of about three seconds is provided to enable the tip of the electrode rod 122 and the coil 123 that has been red heated by the arc discharge return to metal colored state. Note that this cooling may be forced cooling utilizing a certain means, or may be self-cooling. In the present embodiment, self-cooling is employed.

After the cooling period, the second fusing process is performed. The second fusing process may be performed on the conditions, such as an arc current, a duration, a number of times, and a time interval of arc discharge, identical to those used for the first fusing process. Alternatively, the number of times of arc discharge may be changed while the other conditions are the same. In the present embodiment, arc discharge is performed twice in the second fusing process, which differs from the first fusing process. In the second fusing process, the tip of the electrode rod 122 and the coil 123 is red heated again and fused, approaching further into a perfect semi-sphere.

After another cooling period of three seconds, the third fusing process is performed. In the present embodiment, the third fusing process is performed by arc discharge of one time. After the third fusing process, a cooling period of 1.5 seconds is provided. The fourth fusing process, which involves arc discharge of the arc current of 26A one time for 50 milliseconds as in the fusing processes performed so far, is performed. As described above, the four fusing processes transform the tip of the electrode rod 122 and the coil 123 into an almost perfect semi-sphere.

In this way, the fusing process by arc discharge of one or more times is performed intermittently with a cooling period between consecutive fusing processes. As these processes make it easier to control the processing temperature, the tip of the electrode rod 122 and the coil 123 is heated uniformly. This ensures that the electrode tip 124 is formed into an ideal semi-sphere without any defects such as holes or unfused sections.

It should be noted that so-called non-dope pure tungsten in which the total amount of accessory constituents such as Al, Ca, Cr, Cu, Fe, Mg, Mn, Ni, Si, Sn, Na, K, Mo, U, and Th is restricted to 10 ppm or less is used as the material of the electrode 122 and the coil 123 in the present embodiment. Such pure tungsten is used because it is known to suppress blackening of an arc tube of a lamp, thereby improving life characteristics of the lamp such as the luminous flux maintenance factor.

Using the above described electrodes 102 and 103, the inventors of the present invention have tried to develop a high pressure discharge lamp with the lamp power input of 150 (W), the high pressure discharge lamp solving the two technical subjects, that is, to improve a lamp life and to suppress the arc jump phenomenon. The following explains specific design of the high pressure discharge lamp relating to the present embodiment in more detail. The distance between electrodes "De" was set at 1.1 mm for a lamp with the lamp power input of 150 (W). Also, the mercury vapor pressure in the arc tube 101 in the steady lighting state of a lamp was set at 23 MPa, an argon pressure at cooling of the lamp at 20 Kpa, and the charged amount of bromine at $3\times10^{-7}$ mol/cm$^3$. Note in the present embodiment, bromine is composed of $CH_2Br_2$, and the amount of bromine to be charged into the discharge space is adjusted in such a manner that the number of bromine molecules therein is equivalent to the above amount.

Next, the experimental methods in view of improving a lamp life and suppressing the arc jump phenomenon are explained. In the present embodiment, the completed lamp 200 including the arc tube 101 is lit over aging time, and the luminous flux maintenance factor of the lamp over aging time (the ratio of the luminous flux after aging time of one hour to the luminous flux after aging time of a certain period) was measured to examine the lamp life, at the same time, an occurrence state of the arc jump phenomenon was observed.

The above experiment was conducted on the completed lamp 200 incorporated into the lamp unit 300, with the arc tube 101 being set approximately leveled off, as shown in FIG. 5. Aging was performed through a 3.5 hours illumination/0.5 hours off cycle, using a full-bridge electronic ballast that provides rectangular wave lighting with the frequency of 150 Hz.

It should be noted that the luminous flux maintenance factor of the completed lamp 200 was estimated as an average luminance of nine points on a screen illuminated by the lamp unit 300. Also, the aging time at which the luminous flux maintenance factor of the completed lamp 200 decreased to 50% was assumed as a lamp life. Also, an occurrence of the arc jump phenomenon while the completed lamp 200 was lit for two hours after the predetermined aging time (of 100 hours) was checked visually.

The inventors of the present invention thoroughly examined the relationship between (a) the construction of the electrodes 102 and 103 used in the completed lamp 200 with the lamp power input of 150 (W) and (b) its lamp life and an occurrence of the arc jump phenomenon. For the examinations, electrodes varying in the following four parameters were prepared as the electrodes 102 and 103. As shown in FIG. 6B, the four parameters are (1) a shaft diameter "φr" of the electrode rod 122; (2) a wire diameter "φc" of the tungsten wire used for the coil 123; (3) a number of turns "tc" of the coil 123; and (4) the size of the electrode tip 124 formed by the fusing process, that is, a thickness "de" and a diameter "φe" of the electrode tip 124. Experimental lamps employing these electrodes were prepared.

It should be noted that the thickness "de" of the electrode tip 124 can be changed by controlling the duration of the arc discharge and the arc current in the above described fusing process. More specifically, a value of the thickness "de" can be made larger by lengthening the duration of the arc discharge and increasing the arc current. Also, the diameter "φe" of the electrode tip 124 can be determined by selecting the shaft diameter "φr" of the electrode rod 122 and the wire diameter "φc" of the tungsten wire used for the coil 123.

In the present embodiment, the above parameters were respectively set as "φr" in the range of 0.36 to 0.44 mm, "Øc" in the range of 0.18 to 0.22 mm, "tc" in the range of 6 to 10 turns, and "φe×de" in the range of 0.8×0.3 mm to 1.6×1.2 mm. Employing these set parameters, the examinations were performed, resulting in the following observations.

(1) A luminous flux maintenance factor of a lamp that determines a lamp life, and an occurrence of the arc jump phenomenon, depend mainly upon the size of the electrode tip 124 "de×φe", out of the four parameters. Therefore, it can be found that the functions of the electrodes 102 and 103 as electrodes are realized basically by the electrode tip 124.

(2) The larger the size of the electrode tip 124 "de×φe", the more the luminous flux maintenance factor of the lamp is improved in principle, whereas the more the arc jump phenomenon is likely to occur, as far as the size of the electrode tip 124 "de×φe" is in the range stated above. The temperature "Te" of the electrode tip 124 basically decreases as the size of the electrode tip 124 increases. Therefore, to improve the luminous flux maintenance factor, the temperature "Te" needs to be set at a predetermined value "Te·max" or lower. On the other hand, to suppress the arc jump phenomenon, the temperature "Te" needs to be set at a predetermined value "Te·min" or higher.

The reason of the above arrangements of the temperature "Te" is as follows. If the temperature of the electrode tip 124 exceeds the value "Te·max", a larger amount of tungsten material evaporates from the electrode tip 124, increasingly blackening the arc tube. As a result, the luminous flux maintenance factor decreases. On the other hand, If the temperature of the electrode tip 124 falls below the value "Te·min", a discharge arc cannot be stably focused around the center of the electrode tip 124, causing the arc jump phenomenon.

Known from the above examinations is as follows. To realize a longer life of a short-arc high pressure discharge lamp having a shorter arc length than a conventional lamp while suppressing the arc jump phenomenon, which is the object of the present invention, the temperature "Te" of the electrode tip 124 needs to be maintained in the range of "Te·min" to "Te·max".

Figure 8:
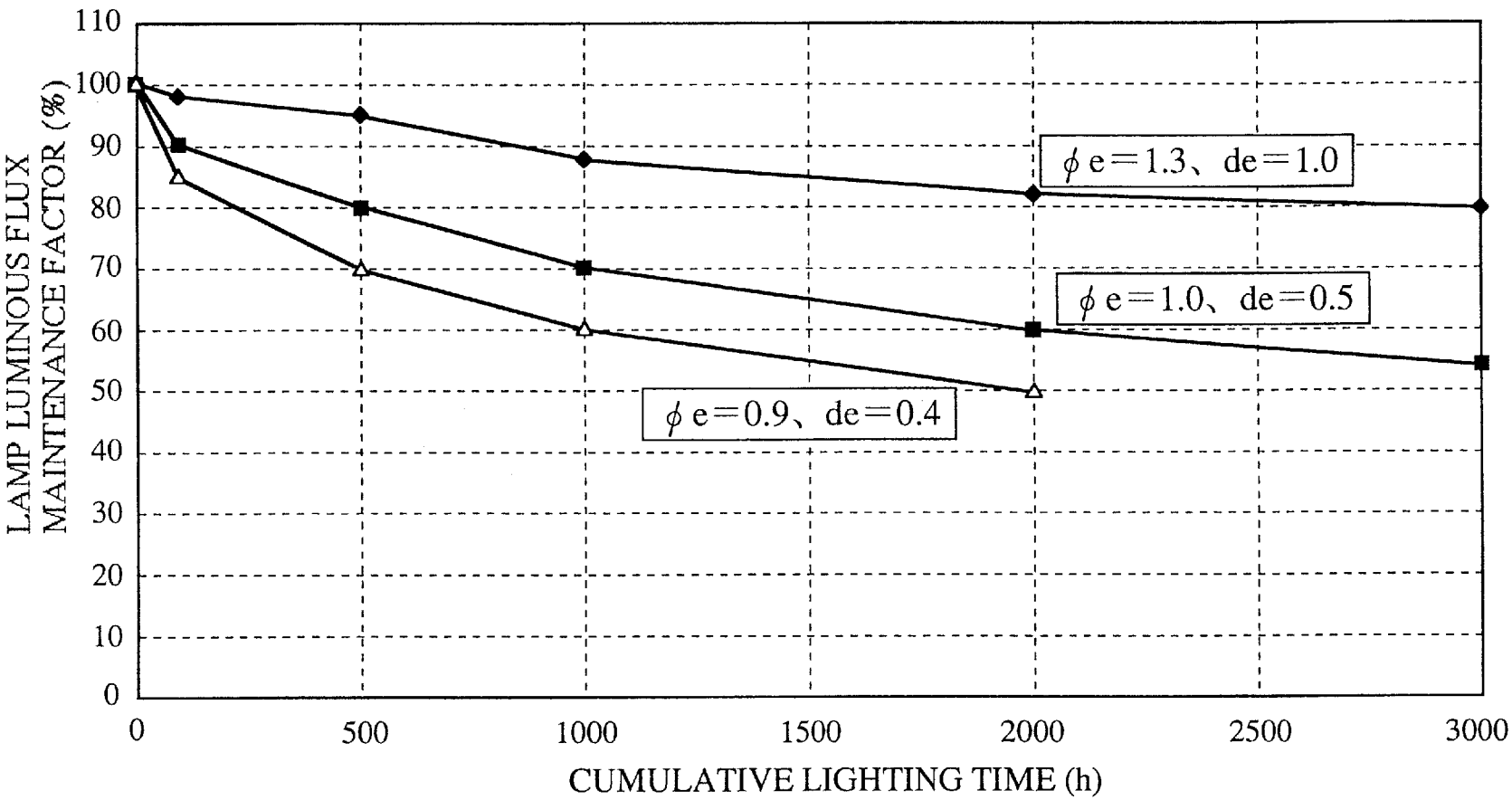
FIG. 8 is a graph showing examination results relating to lives of lamps varying in values of "de" and "φe" when the lamp power input is 150W.

(3) A lamp that can last at least 3000 hours with an occurrence of the arc jump phenomenon in fact being substantially suppressed, which is the object of the present invention, can be realized by the following arrangements discovered by the inventors of the present invention. The size of the electrode tip 124 "φe×de" needs to be set in the range of 1.0×0.5 mm to 1.3×1.0 mm. FIG. 8 shows results of the examinations relating to the lamp life. As shown in the figure, when "φe" is 0.9 mm and "de" is 0.4 mm, the luminous flux maintenance factor is 50% at the cumulative lighting time of 2000 hours. This figure fails to achieve the object of the present invention of the lamp life of 3000 hours. On the other hand, when "φe" exceeds 1.3 mm and "de" exceeds 1.0 mm, the arc jump phenomenon was found to occur. From this, it is considered that variations of the temperature of the electrode tip 124 in the range of "Te·min" to "Te·max" correspond to variations of the size of the electrode tip 124 "φe×de" in the range of 1.0×0.5 mm to 1.3×1.0 mm.

As described above, the inventors' examinations have specified the ranges of the parameters for constructing the electrode tip 124 to solve the two technical subjects relating to short-arc lamps, namely, improving the lamp life and suppressing the arc jump phenomenon that the present invention aims to solve.

Also, the inventors have specified an optimum construction of the electrode tip 124 for each lamp with the lamp power input of other than 150W. In view of providing high pressure discharge lamps varying in the lamp power input (W), experimental lamps varying in the lamp power input of other than 150W were prepared in the same manner as that for the lamp with the lamp power input of 150W. The further examinations were then conducted on the electrodes 102 and 103 to specify the range of the size of the electrode tip 124 "φe×de" in such a manner that the lamp can last for 3000 hours and the arc jump phenomenon can be substantially suppressed. The examination results are shown in Table 1 below.

TABLE 1

| LAMP POWER INPUT (W) | 50 | 100 | 150 | 220 | 300 | 400 |
|---|---|---|---|---|---|---|
| DISTANCE BETWEEN ELECTRODES (mm) | 0.5 | 0.8 | 1.1 | 1.3 | 1.5 | 1.5 |
| φe (mm) | 0.5~0.8 | 0.75~1.1 | 1.0~1.3 | 1.3~1.6 | 1.45~1.8 | 1.7~2.0 |
| de (mm) | 0.2~0.6 | 0.3~0.8 | 0.5~1.0 | 0.75~1.3 | 0.9~1.5 | 1.1~1.75 |

The distance between electrodes "De" was set in the range of 0.5 (when the lamp power input is a minimum of 50W) to 1.5 mm (when the lamp power input is a maximum of 400W). As in the case where the lamp power input is 150W, minimum values of "de" and "φe" were set taking the necessity of achieving the lamp life of 3000 hours into account, and maximum values "de" and "φe" were set taking the necessity of suppressing the arc jump phenomenon into account. As a result of these examinations, an optimum size of the electrode tip 124 for each lamp power input (W) was specified.

Figure 9:
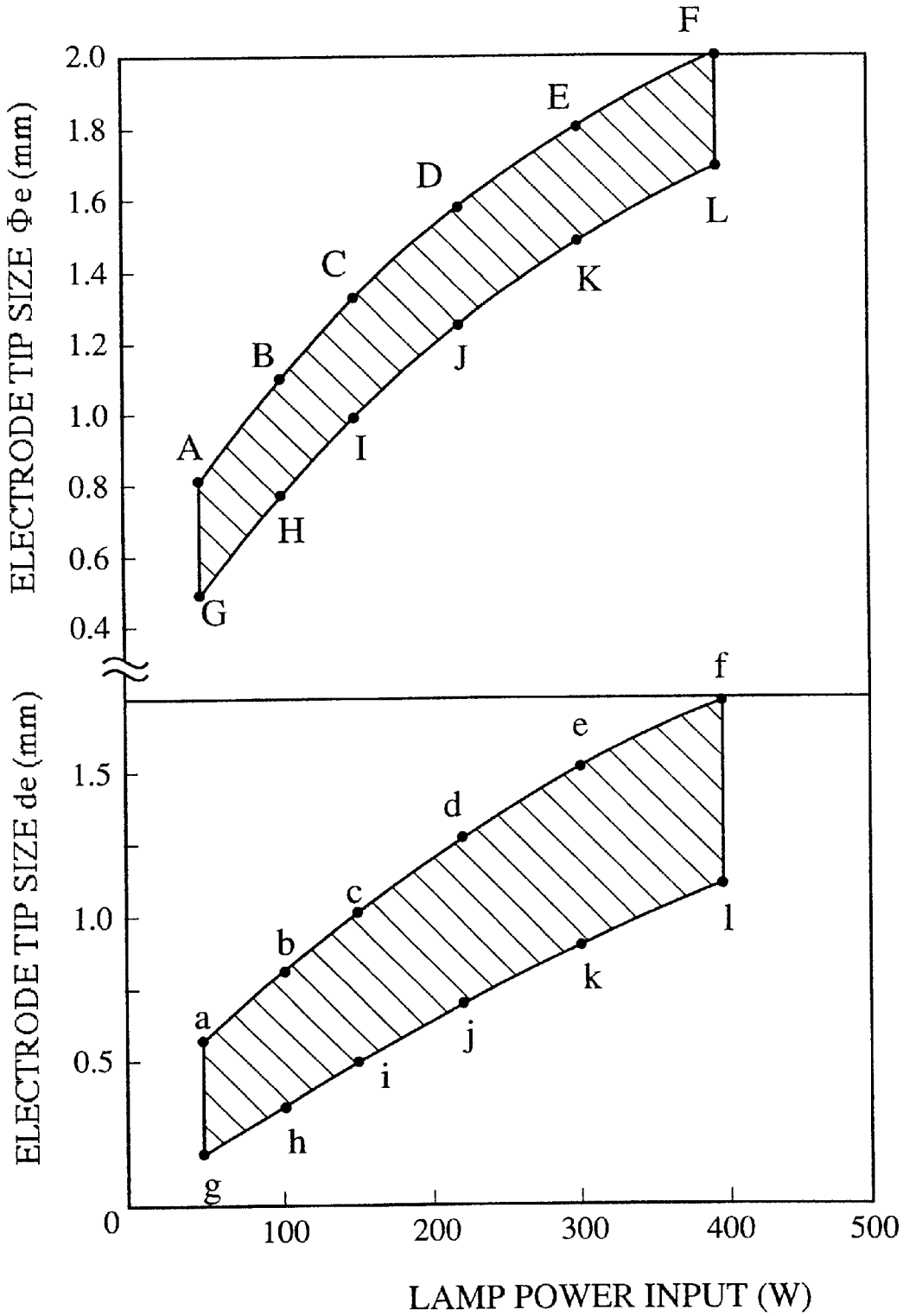
FIG. 9 is a graph showing optimum ranges of "de" and "φe" of lamps varying in the lamp power input (W).

FIG. 9 is a graph showing the results in Table 1. As shown in the figure, a maximum value (point "a" to point "f") and a minimum value (point "g" to point "1") of "de", and a maximum value (point "A" to point "F") and a minimum value (point "G" to point "L") of "φe" tend to increase monotonously as the lamp power input (W) increases. As far as the values of "de" and "φe" are in the range surrounded by plotted points in FIG. 9, that is, in the range indicated by the shaded portion in FIG. 9, it is considered that lamps with any lamp power input (W) other than the lamp power inputs which were particularly examined in this specification can also be made to solve the above two technical subjects.

Note that Table 1 indicates the following case. The distance between electrodes "De" is set at 0.5 mm when the lamp power input is 50W, and is set larger as the lamp power input increases. When the lamp power input is 300W or larger, the distance between electrodes "De" is set at 1.5 mm. The reason of the above arrangements of the distance "De" is as follows. When the lamp power input (W) is small, the size of the lamp is generally small. When combined with a reflector, the smaller the lamp, the smaller the reflector accordingly. Therefore, to appropriately adjust a focal point of a discharge arc, it is preferable to set the distance between electrodes "De" shorter for the smaller lamp power input (W).

However, the ranges of values of "φe(mm)" and "de (mm)" shown in correspondence with each lamp power input (W) in Table 1 is applicable not only to the distance between electrodes "De" specified therein, but to any distance "De" in the range of 0.5 to 1.5 mm. This means as one example, when the lamp power input is 50W and the distance between electrodes "De" is set at 1.5 mm, an improved lamp life and the suppressed arc jump phenomenon that are the effects of the present invention can be realized, by setting the shape of the electrode tip "φe(mm)" and "de(mm)" in the range specified in Table 1.

As described above, by setting the size of the electrode tip 124 "φe×de" that has been processed to form a semi-sphere in a predetermined range according to each lamp power input (W), the lamp life is improved and an occurrence of the arc jump phenomenon with aging is substantially suppressed with reliability. Accordingly, it becomes possible to increase varieties of high quality short-arch high pressure discharge lamps having a shorter arc length than conventional lamps, and provide the high pressure discharge lamps with (a) the stability in luminance on a screen and (b) a lamp life of at least 3000 hours. It should be noted that an argon plasma discharge apparatus is used in the fusing process for the electrode tip 124 in the present embodiment, however, other methods, such as a fusing process utilizing a laser, may instead be employed.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A high pressure discharge lamp, comprising:

an arc tube having sealing parts at both ends thereof and a discharge space formed in the arc tube;

two electrodes extending respectively from the sealing parts into the discharge space, so as to face each other with a predetermined distance "De" therebetween, each electrode being composed of an electrode rod and a coil wound around an end of the electrode rod; and mercury being filled in the discharge space in such a manner that a mercury vapor pressure therein in a steady lighting state is in the range of 15 MPa to 35 MPa inclusive;

wherein the distance "De" is in the range of 0.5 mm to 1.5 mm inclusive, a tip of each electrode has been formed into a semi-sphere by fusing the electrode rod and the coil, and a thickness "de" and a diameter "φe" of the semi-sphere are each in a range predetermined in correspondence with a power input of the high pressure discharge lamp.

2. The high pressure discharge lamp of claim 1, wherein the power input is approximately 150 watts, the thickness "de" is in the range of 0.5 mm to 1.0 mm inclusive, and the diameter "φe" is in the range of 1.0 mm to 1.3 mm inclusive.

3. The high pressure discharge lamp of claim 1, wherein the power input is approximately 50 watts, the thickness "de" is in the range of 0.2 mm to 0.6 mm inclusive, and the diameter "φe" is in the range of 0.5 mm to 0.8 mm inclusive.

4. The high pressure discharge lamp of claim 1, wherein the power input is approximately 100 watts, the thickness "de" is in the range of 0.3 mm to 0.8 mm inclusive, and the diameter "φe" is in the range of 0.75 mm to 1.1 mm inclusive.

5. The high pressure discharge lamp of claim 1, wherein the power input is approximately 220 watts, the thickness "de" is in the range of 0.75 mm to 1.3 mm inclusive, and the diameter "φe" is in the range of 1.3 mm to 1.6 mm inclusive.

6. The high pressure discharge lamp of claim 1, wherein the power input is approximately 300 watts, the thickness "de" is in the range of 0.9 mm to 1.5 mm inclusive, and the diameter "φe" is in the range of 1.45 mm to 1.8 mm inclusive.

7. The high pressure discharge lamp of claim 1, wherein the power input is approximately 400 watts, the thickness "de" is in the range of 1.1 mm to 1.75 mm inclusive, and the diameter "φe" is in the range of 1.7 mm to 2.0 mm inclusive.

8. A high pressure discharge lamp, comprising:

an arc tube having sealing parts at both ends thereof and a discharge space formed in the arc tube;

two electrodes extending respectively from the sealing parts into the discharge space, so as to face each other with a predetermined distance "De" therebetween, each electrode being composed of an electrode rod and a coil wound around an end of the electrode rod; and mercury being filled in the discharge space in such a manner that a mercury vapor pressure therein in a steady lighting state is in the range of 15 MPa to 35 MPa inclusive;

wherein the distance "De" is in the range of 0.5 mm to 1.5 mm inclusive, a tip of each electrode has been formed into a semi-sphere by fusing the electrode rod and the coil, and a thickness "de" of the semi-sphere is in a range within an area defined by twelve coordinate points on an x-y axis system of ("W", "de")=(50, 0.2), (50, 0.6), (100, 0.3), (100, 0.8), (150, 0.5), (150, 1.0), (220, 0.75), (220, 1.3), (300, 0.9), (300, 1.5), (400, 1.1) and (400, 1.75), wherein "W" corresponds to a power input in watts of the high pressure lamp, and "de" corresponds to a size in mm, and a diameter "Øe" of the semi-sphere is in a range within an area that is defined by twelve coordinate points on the x-y axis system of ("W", "Øe")=(50, 0.5), (50, 0.8), (100, 0.75), (100, 1.1), (150, 1.0), (150, 1.3), (220, 1.3), (220, 1.6), (300, 1.45), (300, 1.8), (400, 1.7), and (400, 2.0), wherein "Øe corresponds to a size in mm.

9. A high pressure discharge lamp, comprising:

an arc tube having sealing parts at both ends thereof and a discharge space formed in the arc tube;

two electrodes extending respectively from the sealing parts into the discharge space, so as to face each other with a predetermined distance "De" therebetween, each electrode being composed of an electrode rod and a coil wound around an end of the electrode rod; and mercury being filled in the discharge space in such a manner that a mercury vapor pressure therein in a steady lighting state is in the range of 15 MPa to 35 MPa inclusive;

wherein the distance "De" is in the range of 0.5 mm to 1.5 mm inclusive, a tip of each electrode has been formed into a semi-sphere by fusing the electrode rod and the coil, and a maximum thickness and a minimum thickness of de, and a maximum diameter and a minimum diameter, Øe, of the semi-sphere in mm are each in an approximate range, in correspondence with a power input in watts of the high pressure discharge lamp as follows:

| | WATTS | | | | | |
|---|---|---|---|---|---|---|
| | 50 | 100 | 150 | 220 | 300 | 400 |
| de max. | .6 | .8 | 1.0 | 1.30 | 1.5 | 1.75 |
| de min. | .2 | .3 | .5 | .75 | .9 | 1.10 |
| Øe max. | .8 | 1.10 | 1.3 | 1.6 | 1.80 | 2.00 |
| Øe min. | .5 | .75 | 1.0 | 1.3 | 1.45 | 1.70. |

* * * * *